US006342264B1

(12) United States Patent
Raterman et al.

(10) Patent No.: US 6,342,264 B1
(45) Date of Patent: Jan. 29, 2002

(54) METHOD AND APPARATUS FOR DISPENSING MATERIAL ONTO SUBSTRATES

(75) Inventors: John M. Raterman, Atlanta; Edward C. Taylor, Cumming; John E. Jackson, Alpharetta, all of GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/429,993

(22) Filed: Oct. 29, 1999

(51) Int. Cl.[7] ..... B05D 1/02

(52) U.S. Cl. ..... 427/8; 427/207.1; 427/261; 427/421

(58) Field of Search ..... 427/8, 207.1, 208–208.8, 427/261, 285, 286, 288, 421, 424; 118/668, 669, 670, 680, 681, 684, 685; 222/65, 66; 239/67, 69, 71, 73

(56) References Cited

U.S. PATENT DOCUMENTS 4,735,169 A 4/1988 Cawston et al.
4,894,252 A * 1/1990 Bongen et al.
4,984,109 A 1/1991 Miller et al.
5,016,812 A 5/1991 Pedigrew
5,208,064 A 5/1993 Becker et al.
5,540,946 A 7/1996 DeVries et al.
5,582,663 A 12/1996 Matsunaga
5,589,226 A 12/1996 Geul
5,666,325 A 9/1997 Belser, et al.
5,876,502 A 3/1999 Sugimura et al.
5,922,132 A 7/1999 Martel

OTHER PUBLICATIONS

Sure–Bond™ Pattern Analyzer; © Nordson Corporation; Issued Jul. 7, 1990.

* cited by examiner

*Primary Examiner*—Fred J. Parker
(74) *Attorney, Agent, or Firm*—Raymond J. Slattery III

(57) ABSTRACT

A method and apparatus for dispensing material, including adhesives, onto a substrate, including boxes and cartoons. A first and second dispenser are either operated in a dispense and standby mode or both dispense at least a portion of the dispensed pattern. The detection of a failure of one of the dispensing guns causes the other gun to dispense the complete pattern while de-activating the failed gun thereby maintaining production.

13 Claims, 4 Drawing Sheets

METHOD AND APPARATUS FOR DISPENSING MATERIAL ONTO SUBSTRATES

FIELD OF INVENTION

This invention relates to dispensing and dispensing systems for applying materials to substrates. In particular, this invention relates to the dispensing of adhesives, sealants, caulks, fluxes, encapsulants, and paints. This invention is especially suited to those dispensing applications which require assurance that the material has been deposited onto the substrate and which includes a means for having redundant dispensing so that production may continue in the event of a failure.

BACKGROUND OF THE INVENTION

Applying a liquid material, in particular, an adhesive, by means of an applicator to a substrate in a controlled manner is well known. Applicators, otherwise known as dispensers, guns, or valves, particularly to apply materials to a substrate for adhesion (adhesives, fluxes, etc.) and sealing (paints, encapsulants, etc.). It is also known to provide detection systems (ultraviolet, infrared, vision, etc.) to determine if the material has properly been dispensed. If the material has not been properly dispensed, the substrate may be rejected and/or the line shut down. However, in many applications, failure to properly apply the material to the substrate may cause damage to the substrate and/or cause the substrate or its contents to interfere with the line thereby causing unnecessary down time. For example, in the packaging of beverages, the failure to properly seal the case or carton, may result in the cans spilling from the container onto the conveyor and/or the production floor. The cans may rupture, thereby spilling their contents or may jam the conveying system or otherwise interfere with the transportation of other properly sealed containers. This results in unnecessary down time in cleaning up this accident.

Accordingly, there is a need to provide dispensing systems which not only accurately apply material to a substrate, but in the event of a failure, provide a means for maintaining production, until the failure of the dispenser may be rectified at the scheduled down time of the line thereby maintaining production.

SUMMARY OF THE INVENTION

An object of the present invention is to provide a method and apparatus for dispensing material onto a substrate wherein upon the failure of a dispenser, another dispenser will automatically perform the function of the failed dispenser. This has the advantage of maintaining production until the failed dispenser may be serviced at a more convenient time, such as at the end of a normal production shift. This may be accomplished, by utilizing a standby or secondary dispenser should the first gun fail.

These and other objects, features, and advantages can be accomplished by causing a dispenser to dispense a first pattern of material onto a substrate; causing another dispenser to dispense a second pattern of material onto the substrate; and upon the detection of the failure of material to be dispensed by one of the dispensers, automatically causing the other dispenser to dispense both first and second patterns of material onto the substrate.

These and other objects, features, and advantages can also be accomplished by a method for depositing a material pattern onto a substrate comprising the steps of: dispensing material from a first dispenser so as to deposit a first portion of the pattern of material on the substrate; then dispensing material from a second dispenser to deposit a second portion of the pattern of material on the substrate; sensing the material dispensed from said first and second sensors; and upon determining the absence of the first or second portion of the pattern of material dispensed, automatically causing one of said dispensers to deposit both the first and second portions of the pattern of material to be deposited onto a subsequent substrate.

These and other objects, features, and advantages can be further accomplished by a method for dispensing material comprising the steps of: determining a first actuation sequence; determining a second actuation sequence; determining a third actuation sequence; controlling the actuation of a first dispenser, for dispensing material, in accordance with the first actuation sequence; controlling the actuation of a second dispenser for dispensing material, in accordance with the second actuation sequence; detecting the failure of the first dispenser to dispense the material; and controlling the actuation of the second dispenser in accordance with the third actuation sequence.

These and other objects, features, and advantages can be further accomplished by a method for dispensing adhesive onto a substrate in a pattern having a plurality of discrete adhesive deposits comprising the steps of: a) alternating the actuation of two adhesive dispensers, to dispense discrete streams or drops of adhesive onto the substrate in a pattern; b) sensing the dispensed adhesive; and c) upon the detection of a failure to dispense adhesive, causing a de-activation of the dispenser failing to dispense the adhesive and causing the other dispenser to be actuated to dispense the discrete streams or drops of adhesive from the discharge orifice in order to maintain said pattern.

These and other objects, features, and advantages can be further accomplished by a method of dispensing adhesive onto a substrate comprising the steps of: a) dispensing the adhesive from a first dispenser onto a substrate to produce a first dispensed pattern while maintaining a second dispenser in a standby condition; b) cycling the dispensers from standby to dispense and from dispense to standby after one of the following: i) a period of time, ii) a number of gun firings, or iii) a number of substrates; and c) upon receiving a signal indicating the failure to detect the proper amount of adhesive dispensed, automatically de-activating the dispenser while causing the dispenser in standby to be actuated to dispense the adhesive onto the substrate to produce the first dispensed pattern on at least a subsequent substrate.

BRIEF DESCRIPTION OF THE DRAWINGS

The following is a brief description of the drawings in which like parts may bear like reference numerals and in which.

DESCRIPTION OF THE PREFERRED EMBODIMENT

Figure 1:
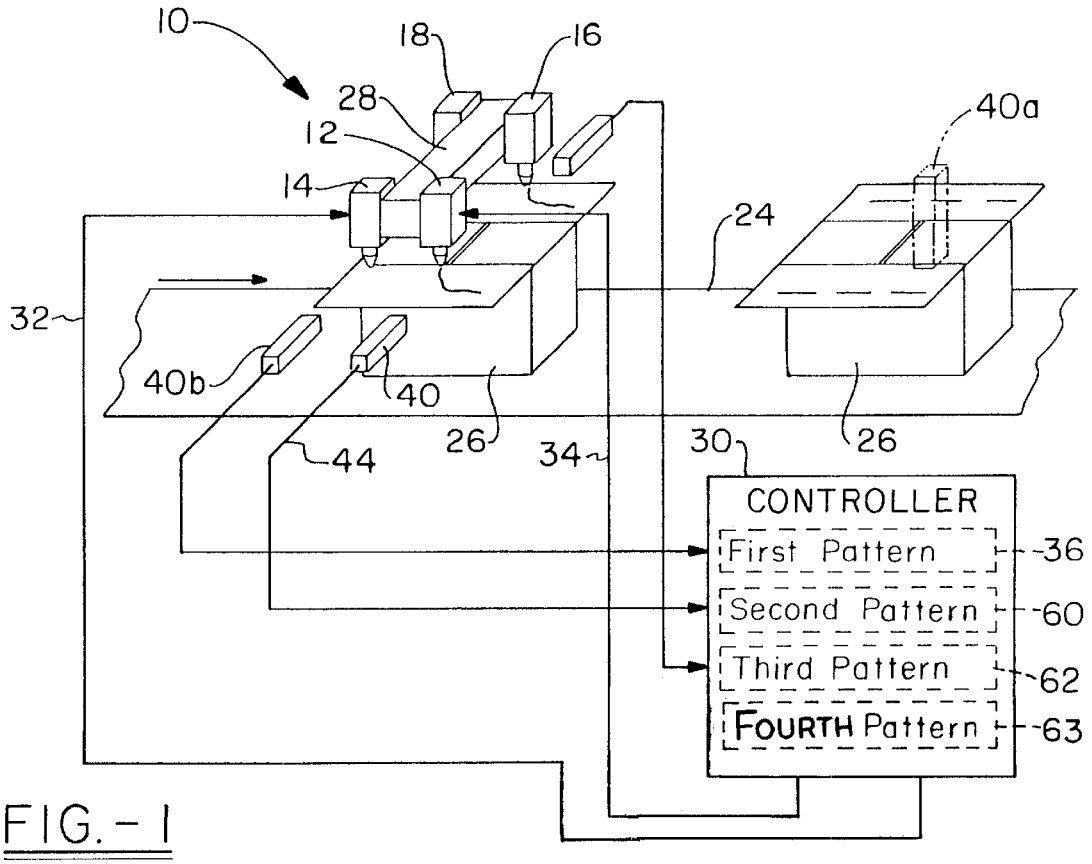
FIG. 1 is a diagrammatic view according to one embodiment of the invention, illustrating a portion of an adhesive dispensing system.
Figure 2:
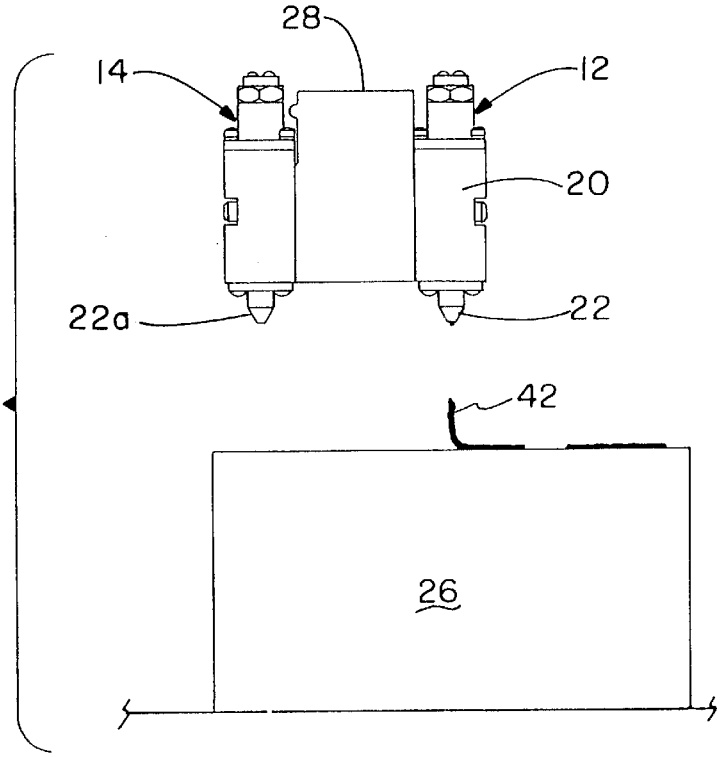
FIG. 2 is a partial enlarged elevational view of the dispensing system of FIG. 1.

With reference to FIGS. 1 and 2, a portion of an adhesive dispensing system is shown generally as reference No. 10. The adhesive dispensing system 10 includes at least a pair of dispensers 12 and 14. Other pairs of dispensers may also be included, such as for example 16 and 18. Each dispenser, may include a valve operated module 20, commonly referred to as a gun module. The gun module 20 may also include a nozzle 22 attached to the outlet of the gun module. The gun module may, for example, be a pneumatically operated valve, such as for example, a Nordson® Model H-200, Model H-400, or Model CF®-200 gun modules manufactured and sold by Nordson Corporation, Westlake, Ohio. The gun module 20 may alternatively be electrically driven and may be, for example, a Nordson Model E-700, E-350, or other electric gun modules manufactured and sold by Nordson Corporation. The gun modules may dispense the material as an extruded bead, drops, droplets, a spray, a swirl spray, etc.

The dispensers 14 and 16, may for example, be positioned above a moving conveyor 24 which transports a substrate 26. For example, the substrate may be a carton, a box, a web, a circuit board or some other object which requires a material to be dispensed onto it. While the material to be deposited is described herein as an adhesive, other materials may be dispensed, such as for example, gasketing materials, sealants, caulks, coatings, fluxes, encapsulants, and paints. While it is preferred that the material to be dispensed is a hot melt adhesive it need not be as other types of non-hot-melt-adhesive may be used instead, including a water base adhesive, commonly known as "cold glue", as well as epoxies.

The gun modules of each dispenser may be attached to a manifold or service block 28. Typically the manifold 28 includes internal passageways for supplying the adhesive to each dispenser. The manifold in turn is typically coupled to a source of adhesive (not shown), such as for example, an applicator unit, drum unloader, etc. for supplying the material to the manifold. The manifold 28 may also be coupled to a source of pressurized air (not shown) to provide air to the dispensers in pneumatically driven modules. In hot melt applications, the manifold will also include internal heaters, transferring heat to the hot melt adhesive, so as to maintain the liquified hot melt adhesive at its proper application temperature.

The actuation of the dispensers 12 and 14 are commonly controlled by a controller 30, via output signals shown generally as lines 32 and 34. In a pneumatic dispenser, the controller 30 provides the electrical power necessary to drive the air solenoid in such a manner as to control the opening and closing of the dispenser in accordance with a desired dispensing pattern.

In other words, the outputs 32, 34 of the controller control the actuation of the air solenoids (not shown) which in turn provide air to drive the opening and/or the closing of the piston of the pneumatic valve. The outputs generated by the controller therefore controls the dispensers in such a manner that the appropriate pattern of material is deposited onto the substrate. The desired pattern is programmed into a controller, sometimes referred to as a pattern controller, in order to obtain the desired pattern necessary for a particular application.

In electrical guns, a solenoid, integral to the gun, drives an armature. Typically, the armature is the plunger or needle which mates at one end with the valve seat to thereby control the flow of the adhesive from the nozzle. Electric guns are typically driven by higher voltage and power requirements than those necessary to drive the typical air solenoid. Therefore, the controller for an electric gun will include not only the pattern controls, but also the circuitry to provide the necessary power to drive the armature properly. Typically, the controller for an electric gun is referred to as a gun driver.

Typically a detector, for example a photo-detector (not shown) is positioned up stream of the dispensers 12, 14 to detect the approaching substrate 26. The detector provides a signal to the controller 30 which is used in conjunction with the stored pattern. The determination of and storage of the appropriate pattern 36 necessary to produce the desired dispensed pattern of adhesive on a substrate is well known. Typically the stored pattern for a gun takes into account the speed of the substrate, the inherent on and off delays, etc. See for example, U.S. Pat. Nos. 4,166,246; 4,380,967; and 4,500,937 hereby incorporated by reference herein.

Therefore, the first dispenser or gun 12 is driven via the output 34 according to a pattern 36 stored in the controller 30. Based on this pattern, the controller generates signals which in turn causes the gun to open and close to produce the desired pattern on the substrate.

The second dispenser or gun 14 of this pair, may be maintained in a standby condition. However when actuated, dispenser 14 will be driven by the controller in a manner in accordance with a second pattern 60 stored in the controller.

A sensor 40 is mounted in such a manner as to sense the material dispensed from dispenser 12. The sensor 40, may be positioned for example, between the nozzle 22 and the substrate 26, thereby monitoring the material as it is being dispensed. Alternatively, a sensor 40*a* (indicated in phantom) may be mounted in such a manner as to monitor the dispensed material on the substrate. The sensor 40 generates a sensor signal 44 which corresponds to the presence or absence of the dispensed material, and is inputted to controller 30. The sensor signal 44 received by the controller is compared to a reference to determine if material is being dispensed properly. When it is determined that the first dispenser has either failed to dispense adhesive or that the pattern is not complete, the controller will cause the output 32 to de-activate the first dispenser 12 while causing the second dispenser 14, to be removed from its standby condition and to be actuated according to the second pattern 60 stored in the controller 30. The sensor 40, may be, for example, an infrared detector, an ultrasonic detector, an optical sensor, etc. depending upon the type of adhesive being dispensed.

Upon the detection of a failure of the material to be dispensed by the first dispenser 12, the second dispenser 14 may begin its dispensing either with the next substrate 26 or, depending upon the placement of the sensing equipment, the speed of response, etc., the second dispenser 14 may begin to dispense material immediately onto the substrate, thereby placing at least some of the material onto the present substrate. While this latter method may result in the substrate not receiving a complete pattern or the proper amount of material, this may have, in certain circumstances, the benefit of allowing the substrate to be processed easier to a repair station while maintaining production. For example, in the sealing of beverage cartons, if the flap of the carton does not seal, the cans may fall from the container onto the conveyor and/or the production floor. This may cause a stoppage of the line until the cans and the container are removed. However, by causing the second dispenser 14 to immediately dispense adhesive onto the substrate, the amount of adhesive dispensed (while not necessarily enough to keep the container closed during normal shipment and handling), may be sufficient to keep the container closed long enough to be removed from the main conveyor line and sent to a repair station for proper gluing. This eliminates the potential opening of a container on the conveyor line thereby preventing unnecessary down time to the main processing line.

The materials that may be dispensed, including hot melt adhesives, may make it necessary in normal operation to cycle the second gun 14 to dispense material to prevent problems associated with a stagnate material. In such case, the guns may occasionally be alternated so that the first gun 12 may be placed in standby and the second gun 14 may now be the gun used for dispensing the adhesive onto the substrate. The rotation or cycling of the guns from a dispensing mode to a standby mode by be preprogrammed based on the passage of time, the number of substrates dispensed, gun firings, etc.

Figure 1A:
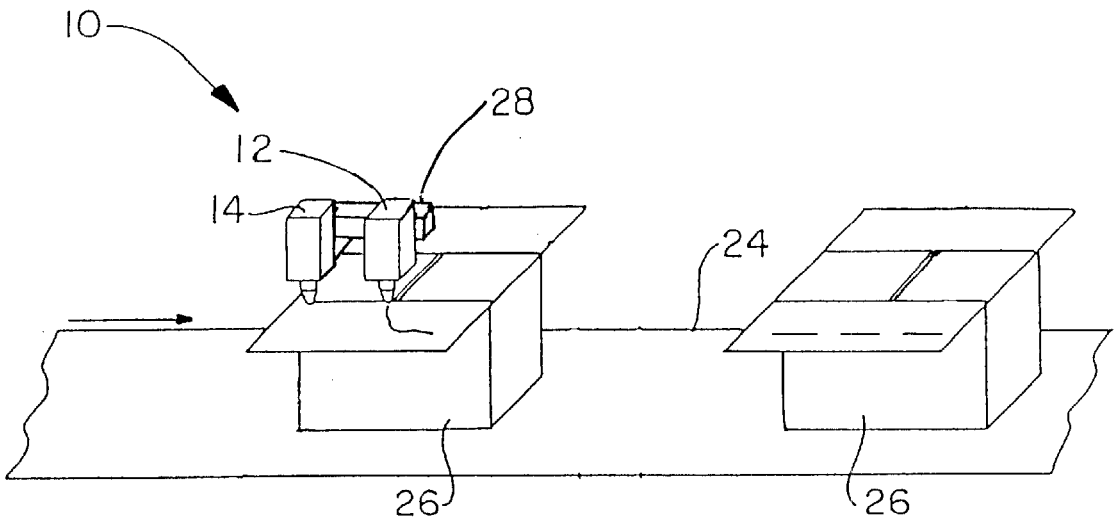
FIG. 1A is a diagrammatic view according to an alternative mounting arrangement of one set of guns according to the invention, illustrating a portion of an adhesive dispensing system.

Generally, the outlet of nozzles 22, 22*a* of the first and second dispensers 12, 14 will be in line substantially with one another, in the direction of movement of the substrate, so that each is able to dispense the same pattern of material. The guns may be mounted in any number of ways to accomplish this. For example, with reference to FIG. 1A, the guns 12, 14 may be mounted to a manifold 28 wherein the manifold is in line with the direction of the movement of the substrate. However, there may be circumstances in which the exact placement of the adhesive may not be that critical and as a result the first and second dispensers may be somewhat offset.

Figure 3A:
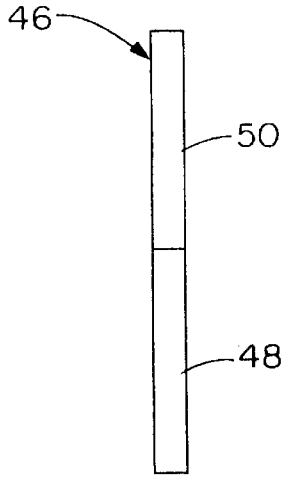
FIGS. 3A–3D are various adhesive dispensing patterns.
Figure 3B:
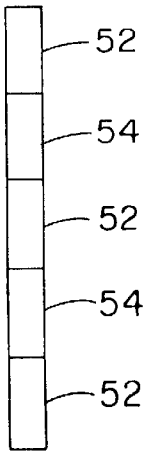
Figure 3C:
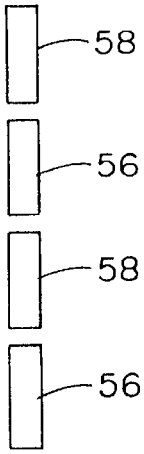
Figure 3D:
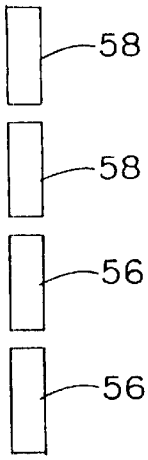

Furthermore, the first and second dispensers may be configured to operate to dispense a portion of the pattern desire for each substrate. For example, with reference to FIGS. 3A–3D, if the pattern to be dispensed is a bead 46, the first dispenser may dispense the first half of the bead 48 and the second half of the bead 50 may be dispensed by the second dispenser. Alternatively, the guns may be cycled ON/OFF through the course of a dispensing cycle to dispense various portions of the pattern. For example, the first dispenser may dispense various segments of the bead 52, while the second dispenser dispenses other segments, thereby producing a completed bead. Similarly, the pattern could include a number of spaced apart segments or beads, commonly known as a stitching pattern wherein a number of beads or segments 56 are dispensed by one dispenser and the other beads 58 are dispensed by the second dispenser, see for example FIGS. 3C and 3D.

In cycling between the first 12 and second 14 guns to produce the pattern of adhesive to a substrate, a sensor 40*a* may monitor the dispensed pattern on the substrate as before or a first 40 and second 40*b* sensor may be used to dispense the material dispensed from the orifice of the first and second dispensers prior to its contacting the substrate.

Upon the sensing or the detecting of the failure of one of the first 12 or second 14 dispensers to dispense the material 42 properly, the other sensor is controlled to produce the pattern on the substrate that would have resulted from both guns. For example with reference to FIG. 3C, if the first dispenser is dispensing adhesive beads 56, and the second dispenser is dispensing a second set of adhesive beads 58, upon the detection that these patterns are not being dispensed properly, such as the absence of one or more of beads 56, such as when the first gun has failed, will be de-activated and the second gun will now be controlled to produce the complete pattern of dispensed beads 56 and 58. In other words, if the pair of guns 12, 14 were dispensing one of the patterns of FIGS. 3A–3D for example, and one failed, the other gun would be controlled to produce the desired pattern.

This may be accomplished, for example, by storing the a pattern 36 in the pattern controller to control the first dispensing gun 12, and a second pattern 60 in the pattern controller to control the second dispensing gun 14. A third pattern 62, could be stored in the pattern controller such as to drive the first dispensers so that it will be able to produce the complete pattern that would normally be attained with both guns. A fourth pattern 63 could be stored in the pattern controller such as to drive the second dispenser so that it will be able to produce the complete pattern. Upon the detection that one of the dispensers has failed to properly dispense the material, the failed dispenser will be de-activated and the properly actuating dispenser will be then driven according to the complete pattern stored, either the third 62 or the fourth 63 pattern.

Figure 4:
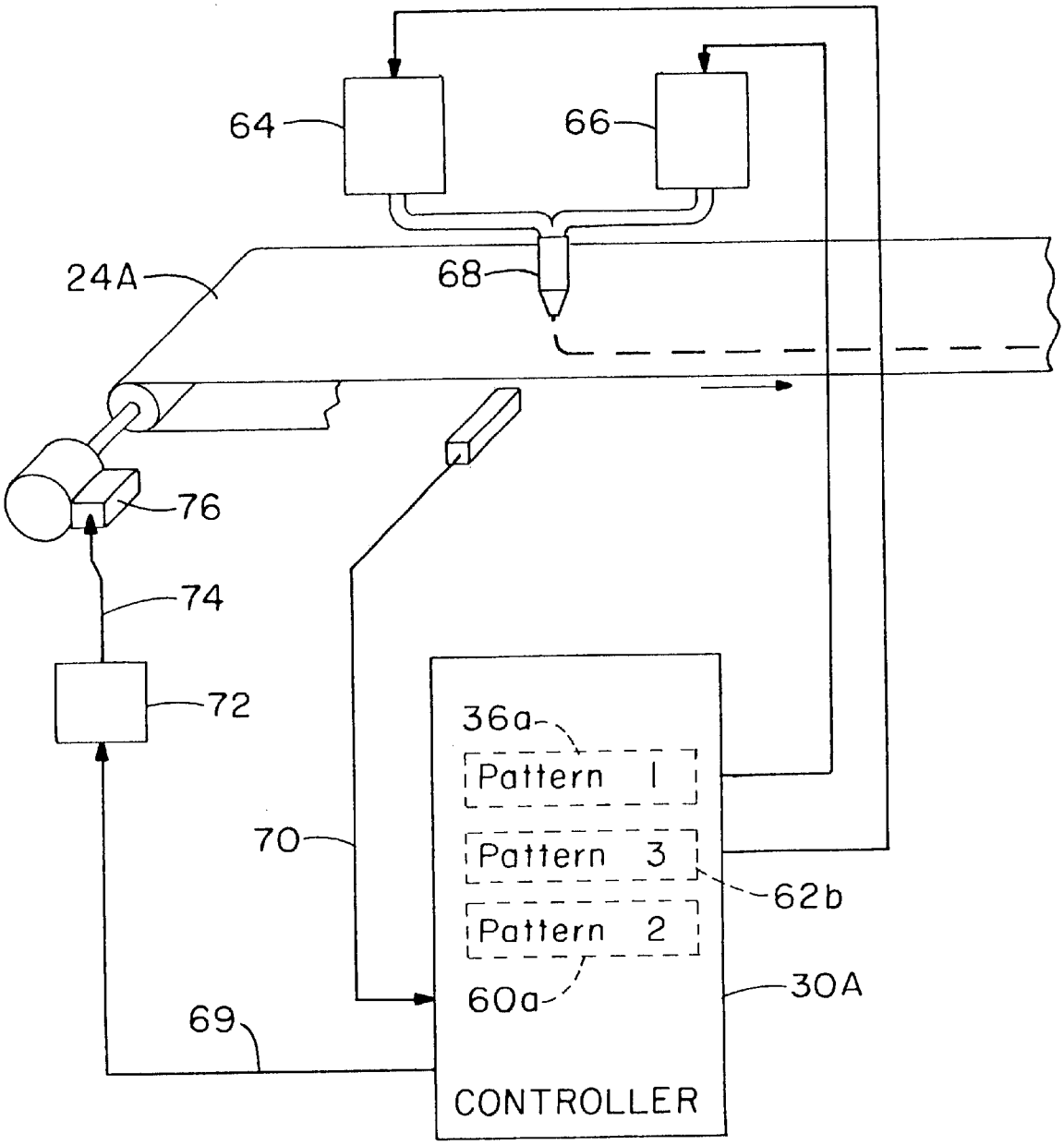
FIG. 4 is another embodiment of a dispensing system according to the invention.

With reference to FIG. 4, it has been known to utilize two dispensing guns 64, 66 to feed one dispensing orifice/nozzle 68. For example, U.S. Pat. No. 5,589,226, incorporated herein by reference, utilizes a pair of dispensing guns in order to provide faster cycling rates to produce smaller beads and/or smaller spacing between the beads or dots. In such an arrangement, the first and second dispensing guns are each controlled by a controller 30*a* with respect to a first 36*a* and second pattern 60*a* respectively. Upon the detection 70 that one of the dispensing guns 64, 66 has failed to properly dispense material, such as the absence of a bead, the other dispensing gun will be controlled by another stored pattern, such as third pattern 62*b* or fourth 63*a* as above, so as to be able to continue dispensing material. However, this will necessitate a reduction in the line speed. A signal 69 is sent to the controller 72 controlling the line speed so that the line speed controller 72 will produce an appropriate control signal 74 to the motor drive 76 of the conveyor 24*a* in order to reduce the line speed. Reducing the line speed may be necessary in order to allow the gun to have sufficient time to open and close in order to properly dispense material onto the substrate in the desired pattern. This allows the production to continue, albeit, at a reduced speed, until the failure can be corrected.

While the nozzles associated heretofore have been illustrated as a single orifice nozzle, they need not be. The nozzles, could in fact be slot nozzles, or multi-orifice nozzles for producing various patterns onto the substrate. However, the nozzles of the first and second dispensers will be generally need to be substantially the same, so as to be able to each provide the required pattern should one fail.

Figure 5:
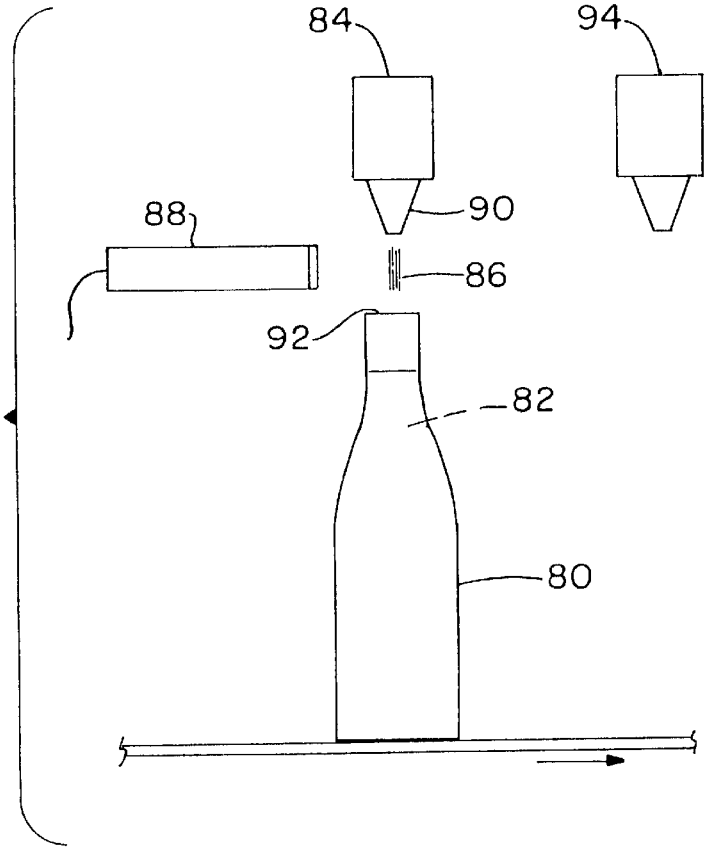
FIG. 5 is another embodiment of a dispensing system according to the invention.

This invention may also be used for many other applications, including beer production. With reference to FIG. 5, for example, in the bottling of beer, once the bottle 80 has been filled with beer 82, a dispenser 84 dispenses a shot of water 86 into the bottle of beer. This causes the beer to foam thereby producing gas which in turn evacuates the bottle of air prior to capping. A sensor 88 may be disposed between the orifice or nozzle 90 of the dispenser 84 and the mouth 92 of the bottle, if the sensor 88 fails to verify the shot of water dispensed from the first dispenser 84, a second dispenser 94 could be activated to dispense the shot of water as the bottle 80 passed beneath it in order to ensure that the water was actually dispensed into the beer, thereby ensuring that air has been evacuated from the bottle prior to capping.

While certain representative embodiment details have been shown for the purposes of illustrating the invention, it will be apparent to those skilled in the art that various changes and modifications may be made therein without departing from the scope of the invention. For example, upon the detection of a failure of one of the guns, an alarm may be indicated.

It is claimed:

1. A method for dispensing material comprising the steps of:

causing a dispenser to dispense a first pattern of material onto a substrate;

causing another dispenser to dispense a second pattern of material onto the substrate; and upon the detection of the failure of material to be dispensed by one of said dispensers, automatically causing the other dispenser to dispense both first and second patterns of material onto the substrate.

2. The method of claim 1 wherein the material is an adhesive.

3. A method for depositing a material pattern onto a substrate comprising the steps of:

dispensing material from a first dispenser so as to deposit a first portion of the pattern of material on the substrate;

then dispensing material from a second dispenser to deposit a second portion of the pattern of material on the substrate;

sensing the material dispensed from said first and second dispensers; and upon determining the absence of the first or second portion of the pattern of material dispensed, automatically causing one of said dispensers to deposit both the first and second portions of the pattern of material to be deposited onto a subsequent substrate.

4. The method of claim 3 wherein the material is an adhesive.

5. The method of claim 3 wherein the sensing step includes sensing the material at an outlet of the first dispenser.

6. The method of claim 3 wherein the sensing step includes sensing the deposited pattern of material on the substrate.

7. A method for dispensing material comprising the steps of:

determining a first actuation sequence for actuating a dispenser to dispense a material;

determining a second actuation sequence for actuating a dispenser to dispense a material;

determining a third actuation sequence for actuating a dispenser to dispense a material;

controlling actuation of a first dispenser, to dispense material, in accordance with the first actuation sequence;

controlling actuation of a second dispenser to dispense material, in accordance with the second actuation sequence;

detecting a failure of the first dispenser to dispense the material; and controlling actuation of the second dispenser in accordance with the third actuation sequence.

8. The method of claim 7 wherein the material is an adhesive.

9. A method for dispensing adhesive onto a substrate in a pattern having a plurality of discrete adhesive deposits comprising the steps of:

(a) alternating the actuation of two adhesive dispensers, to dispense discrete streams or drops of adhesive onto the substrate in a pattern;

(b) sensing the dispensed adhesive; and (c) upon the detection of a failure to dispense adhesive, causing a de-activation of the dispenser failing to dispense the adhesive and causing the other dispenser to be actuated to dispense the discrete streams or drops of adhesive in order to maintain said pattern.

10. The method of claim 9 wherein step (a) further comprises:

discharging the discrete streams or drops of adhesive from a discharge orifice which is coupled to a discharge outlet of each dispenser.

11. The method of claim 10 further comprising the step of generating an alarm signal in response to step (c).

12. The method of claim 10 wherein the substrate is carried by a conveyor operating at a line speed; and further comprising the step of decreasing the line speed in response to step (c).

13. A method of dispensing adhesive onto a substrate comprising the steps of:

(a) dispensing the adhesive from a first dispenser onto a substrate to produce a first dispensed pattern while maintaining a second dispenser in a standby condition;

(b) cycling the dispensers from standby to dispense and from dispense to standby after one of the following:

i) a period of time, ii) a number of dispenser firings, or iii) a number of substrates have passed the first and second dispensers; and (c) upon receiving a signal indicating the failure to detect dispensed adhesive, automatically de-activating the dispenser to dispense adhesive while causing the dispenser in standby to be actuated to dispense the adhesive onto the substrate to produce the first dispensed pattern on at least a subsequent substrate.

* * * * *